US011428387B2

(12) United States Patent
Liang et al.

(10) Patent No.: US 11,428,387 B2
(45) Date of Patent: Aug. 30, 2022

(54) LIGHTING APPARATUS

(71) Applicant: XIAMEN LEEDARSON LIGHTING CO., LTD, Fujian (CN)

(72) Inventors: Jinhui Liang, Fujian (CN); Shouqiang Hou, Fujian (CN); Xiaoliang Wen, Fujian (CN); Yongzhe Dong, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/107,688

(22) Filed: Nov. 30, 2020

(65) Prior Publication Data

US 2021/0190298 A1 Jun. 24, 2021

(30) Foreign Application Priority Data

Dec. 20, 2019 (CN) ..... 201922318720.3

(51) Int. Cl.

| | |
|---|---|
| ***F21V 17/02*** | (2006.01) |
| ***F21V 23/00*** | (2015.01) |
| ***F21V 17/10*** | (2006.01) |
| ***F21V 23/06*** | (2006.01) |
| ***F21V 3/00*** | (2015.01) |
| *F21V 23/04* | (2006.01) |
| *F21Y 115/10* | (2016.01) |

(52) U.S. Cl.

CPC ..... *F21V 17/02* (2013.01); *F21V 3/00* (2013.01); *F21V 17/104* (2013.01); *F21V 23/009* (2013.01); *F21V 23/06* (2013.01); *F21V 23/04* (2013.01); *F21Y 2115/10* (2016.08)

(58) Field of Classification Search

CPC ..... F21V 17/02; F21V 17/104; F21V 23/009

See application file for complete search history.

(56) References Cited

U.S. PATENT DOCUMENTS

| | | | | |
|---|---|---|---|---|
| 2008/0106892 | A1* | 5/2008 | Griffiths | F21V 11/10 362/223 |
| 2013/0039052 | A1* | 2/2013 | Forteza | F21V 17/104 362/223 |
| 2013/0039067 | A1* | 2/2013 | Wong | F21V 33/006 362/249.06 |
| 2015/0308129 | A1* | 10/2015 | Peck | F21V 15/01 362/217.11 |
| 2016/0327250 | A1* | 11/2016 | Czech | F21V 14/04 |
| 2016/0348851 | A1* | 12/2016 | Amrine, Jr. | F21V 23/06 |
| 2016/0363296 | A1* | 12/2016 | Hayashi | F21V 29/89 |
| 2020/0032964 | A1* | 1/2020 | Duan | F21K 9/275 |

* cited by examiner

*Primary Examiner* — Bryon T Gyllstrom
*Assistant Examiner* — Christopher E Dunay
(74) *Attorney, Agent, or Firm* — Chun-Ming Shih; Lanway IPR Services

(57) ABSTRACT

A lighting apparatus includes a tilt housing, a bottom plate, a first cap cover, a second cap cover, a driver, a light source plate and a light passing cover. The lighting apparatus may be installed in a closet. The tilt housing includes a tilt plate, a top plate and a side plate. The tilt plate has a first side connected to the top plate. The bottom plate has a front side connected to a second side of the tilt plate. The bottom plate also has a back side connected to the side plate. The second side is opposite to the first side in the tilt plate. The bottom plate and the tilt housing form a polygonal tube defining an inner container. The first cap cover and the second cap cover are fixed to two opposite ends of the polygonal tube for concealing the inner container.

16 Claims, 11 Drawing Sheets

LIGHTING APPARATUS

FIELD

The present invention is related to a lighting apparatus, and more particularly related to a lighting apparatus used in a closet.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

People need to place light devices in various closets. These light devices need to be more flexible and have lower cost.

In addition, it is beneficial to design light devices that are easily to be installed and positioned to provide illumination in various applications.

SUMMARY

In some embodiments, a lighting apparatus includes a tilt housing, a bottom plate, a first cap cover, a second cap cover, a driver, a light source plate and a light passing cover.

The lighting apparatus may be installed in a closet.

The tilt housing includes a tilt plate, a top plate and a side plate.

The tilt plate has a first side connected to the top plate. A tilt angle between the first side of the tilt plate and the top plate is between 100 degrees to 170 degrees.

The bottom plate has a front side connected to a second side of the tilt plate. The bottom plate also has a back side connected to the side plate.

The second side is opposite to the first side in the tilt plate.

The bottom plate and the tilt housing form a polygonal tube defining an inner container.

The first cap cover and the second cap cover are fixed to two opposite ends of the polygonal tube for concealing the inner container.

The driver is disposed in the inner container.

The light source plate is placed on an exterior side of the tilt plate.

The light passing cover has a top end fixed to the first side of the tilt plate and has a bottom end fixed to the second side of the tilt plate.

In some embodiments, the tilt plate, the top plate and the side plate are elongated rectangular plates.

In some embodiments, the top plate and the tilt plate are connected with a first sliding track structure.

In some embodiments, the light source plate is placed on the exterior side of the tilt plate with a first sliding structure.

In some embodiments, the light passing cover is an elongated convex structure.

In some embodiments, the light passing cover has a pair of plugging ears to be inserted to the second sliding track.

In some embodiments, there are multiple prism units disposed on the light passing cover for diffusing a light of the light source plate.

In some embodiments, there are multiple wave bars protruding form a base surface of the light passing cover for diffusing a light of the light source plate.

In some embodiments, the light passing cover and the tilt plate are connected with a second sliding track structure.

In some embodiments, the first cap cover has a conductive path for electrically connecting LED modules on the light source plate and the driver.

In some embodiments, terminal plugs are disposed for electrically connecting the LED modules and the driver to the conductive path when the first cap cover is fix to the polygonal tube.

In some embodiments, the first cap cover and the second cap cover respectively have a positioning groove for inserting two lateral sides of polygonal tube.

The positioning groove ensure a shape of the polygonal tube unchanged.

In some embodiments, the first cap cover has a first cap connector fixed to a first tube connector of the polygonal tube for preventing the first cap detached from the polygonal tube.

In some embodiments, the first cap connector has a protruding block to be inserted to a connector hole on the top plate as the first tube connector.

In some embodiments, the protruding block has an elastic unit for lowering the protruding block when the protruding block is moved along a first sliding track disposed on the top plate before the protruding block is inserted to the connector hole with an elastic force of the elastic unit.

In some embodiments, the first cap connector includes a screw hole aligning with a screw opening of the first tube connector for inserting a first screw to fix the polygonal tube with the first cap cover.

In some embodiments, there is a retractable curtain disposed on the light passing cover for selectively changing a luminance area of the light passing cover.

In some embodiments, a manual switch is disposed on the top plate.

The manual switch is electrically connected to the driver for changing a control setting of LED modules on the light source plate.

In some embodiments, the driver includes a driver circuit disposed on a driver plate.

The driver plate is inserted into the inner container via a third sliding track.

In some embodiments, the first cap cover has an extending socket for routing electricity to another light device.

DETAILED DESCRIPTION

Figure 9:
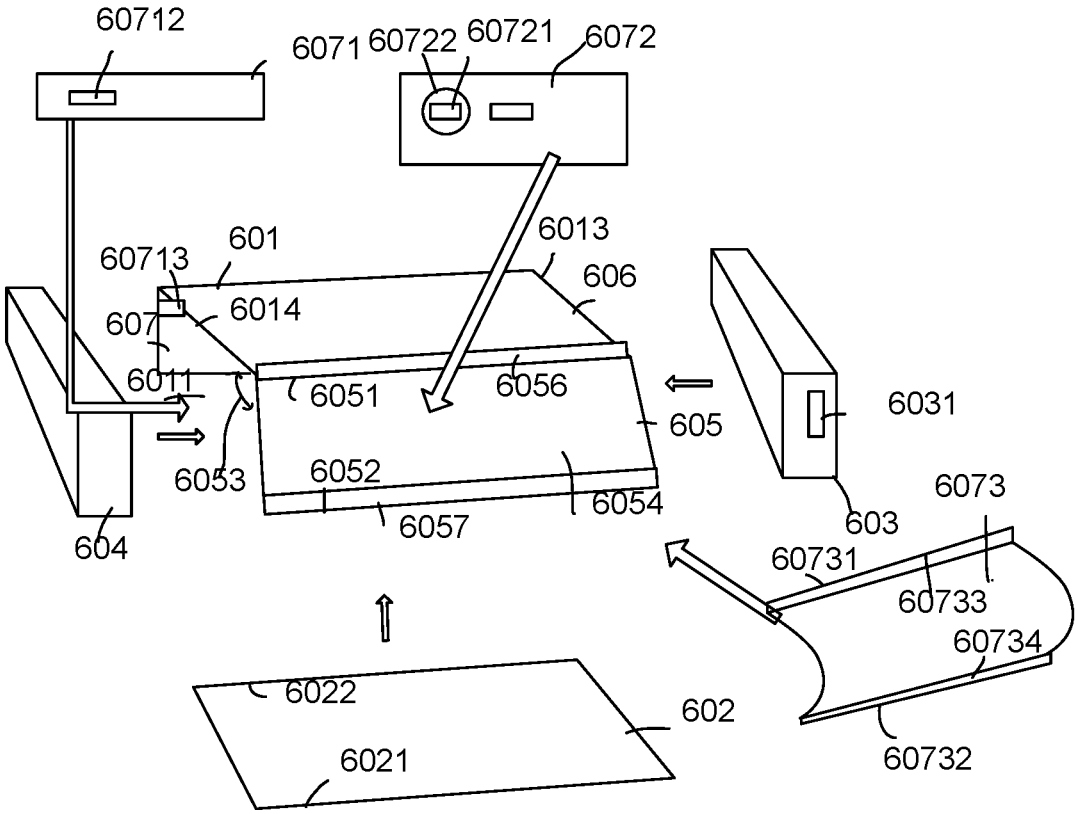
FIG. 9 shows another embodiment.

Please refer to FIG. 9. In FIG. 9, a lighting apparatus includes a tilt housing 601, a bottom plate 602, a first cap cover 603 and a second cap cover 604. The tilt housing 601 includes a tilt plate 605, a top plate 606 and a side plate 607. The lighting apparatus may be installed in a closet or other places.

The tilt plate 605 has a first side 6051 connected to the top plate 606. A tilt angle 6053 between the first side 6051 of the tilt plate 605 and the top plate is between 100 degrees to 170 degrees.

The bottom plate 602 has a front side 6021 connected to a second side 6052 of the tilt plate 605. The bottom plate 602 also has a back side 6022 connected to the side plate 607.

The second side 6052 is opposite to the first side 6051 in the tilt plate 605.

The bottom plate 602 and the tilt housing 601 form a polygonal tube, which is the combined structure of the tilt housing 601 and the bottom cover 602, defining an inner container 6011.

The first cap cover 603 and the second cap cover 604 are fixed to two opposite ends 6013, 6014 of the polygonal tube for concealing the inner container 6011.

A driver 6071 is disposed in the inner container 6011. The driver 6071 may include circuits for rectifying an alternating current to a direct current power, a filter for filtering output currents and/or controlling intensities of LED modules 60721 disposed on a light source plate 6072.

The light source plate 6072 may also have diffusing lenses 60722 respectively covering the LED modules 60721 for diffusing the light of the LED modules. With such design, the light of the light source plate 6072 is more evenly.

A light source plate 6072 is placed on an exterior side 6054 of the tilt plate 605.

A light passing cover 6073 has a top end 60731 fixed to the first side 6051 of the tilt plate 605 and has a bottom end 60732 fixed to the second side 6052 of the tilt plate 605. The light passing cover 6073 may further diffuse the light of the LED modules 60721.

In FIG. 9, the tilt plate 605, the top plate 606 and the side plate 607 are elongated rectangular plates.

In some embodiments, the top plate 606 and the tilt plate 605 are connected with a first sliding track structure.

In some embodiments, the light source plate 6072 is placed on the exterior side 6054 of the tilt plate 605 with a first sliding structure 6056. Specifically, the light source plate 6072 may have block edges corresponding to two sliding tracks disposed on the tilt plate 605. The light source plate 6072 is attached to the tilt plate 605 by inserting the block edges into the sliding tracks.

In some embodiments, the light passing cover 6073 is an elongated convex structure. Specifically, there is a protruding container space above the light source plate 6072.

In some embodiments, the light passing cover 6073 has a pair of plugging ears 60733, 60734 to be inserted to the second sliding track 6057.

Figure 5:
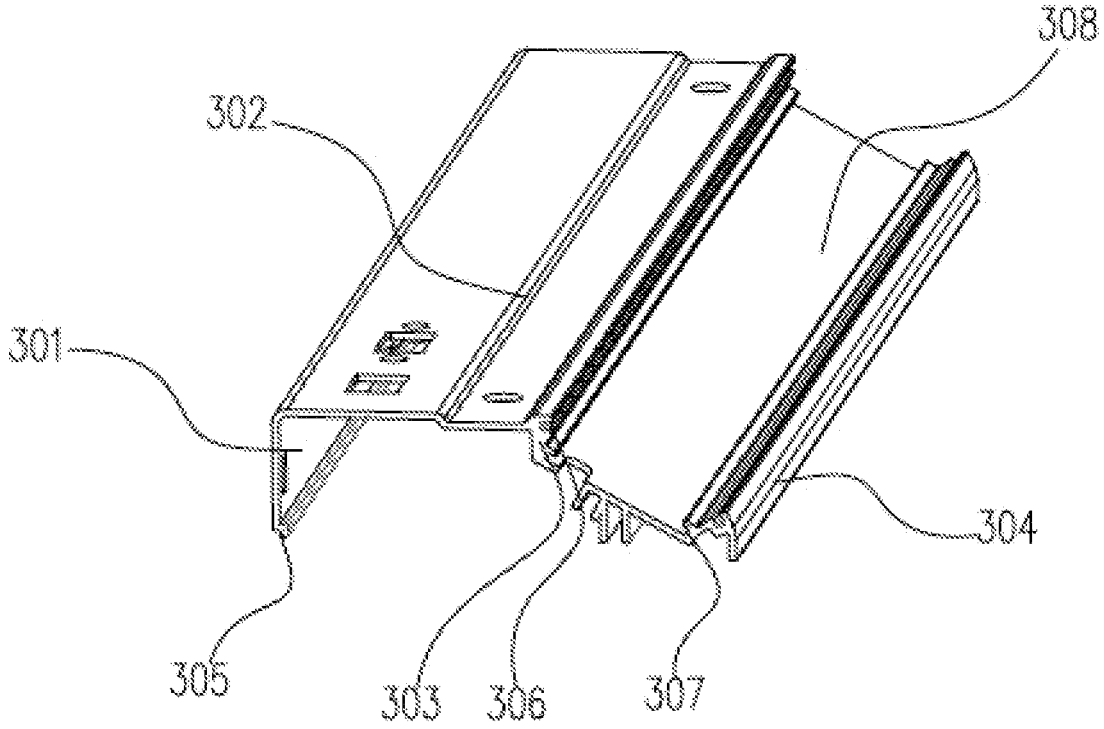
FIG. 5 illustrates a diagram showing the tilt housing.

The second sliding track 6057 may include two sliding tracks on the tilt plate 605 corresponding to the pair of plugging ears 60733, 60734 so that the pair of plugging ears 670733, 60734 are sliding into the sliding tracks. FIG. 5 show a more detailed example for such arrangement.

Figure 10:
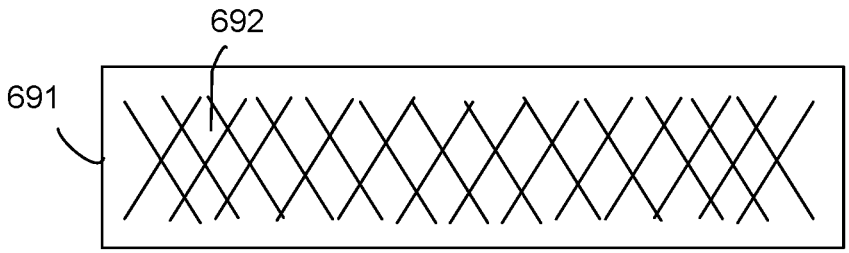
FIG. 10 shows prism units disposed on a light passing cover.

In FIG. 10, there are multiple prism units 692 disposed on the light passing cover 691 for diffusing a light of the light source plate.

Figure 11:
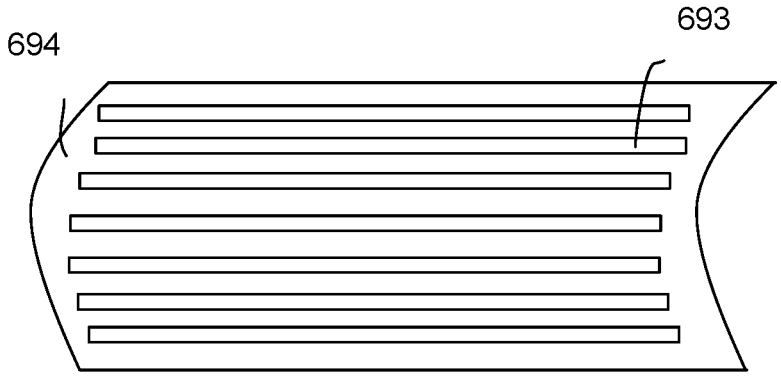
FIG. 11 shows wave bars disposed on a light passing cover.

In FIG. 11, there are multiple wave bars 693 protruding form a base surface of the light passing cover 694 for diffusing a light of the light source plate. In some embodiments, there are more wave bars 693 disposed at center positions then at peripheral positions of the light passing cover 694. Such setting makes light rendered on the light passing cover 694 more even.

In some embodiments, the light passing cover and the tilt plate are connected with a second sliding track structure.

Figure 12:
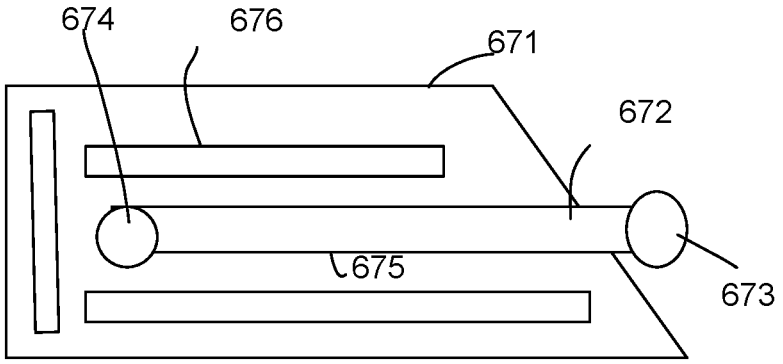
FIG. 12 shows an example of a first cap cover.

In FIG. 12, the first cap cover 671 has a conductive path 672 for electrically connecting LED modules on the light source plate and the driver. Specifically, the light source plate is placed at one side of the tilt plate while the driver is placed at the other side of the tilt plate as illustrated in FIG. 9. In some embodiments, the conductive path may be passing through the tilt plate. In some other embodiments, the conductive path 672 is placed on the first cap cover for electrically connecting the LED modules of the light source plate and the driver, e.g. with two terminal plugs 673, 674 connected with a metal strip 675.

In some embodiments, terminal plugs 673, 674 are disposed for electrically connecting the LED modules and the driver to the conductive path when the first cap cover is fix to the polygonal tube.

In some embodiments, the first cap cover and the second cap cover respectively have a positioning groove 676 for inserting two lateral sides of polygonal tube. Specifically, the polygonal tube has multiple side edges, and there may be corresponding positioning grooves for inserting side edges of the polygonal tube to ensure a shape of the polygonal tube unchanged.

Figure 2:
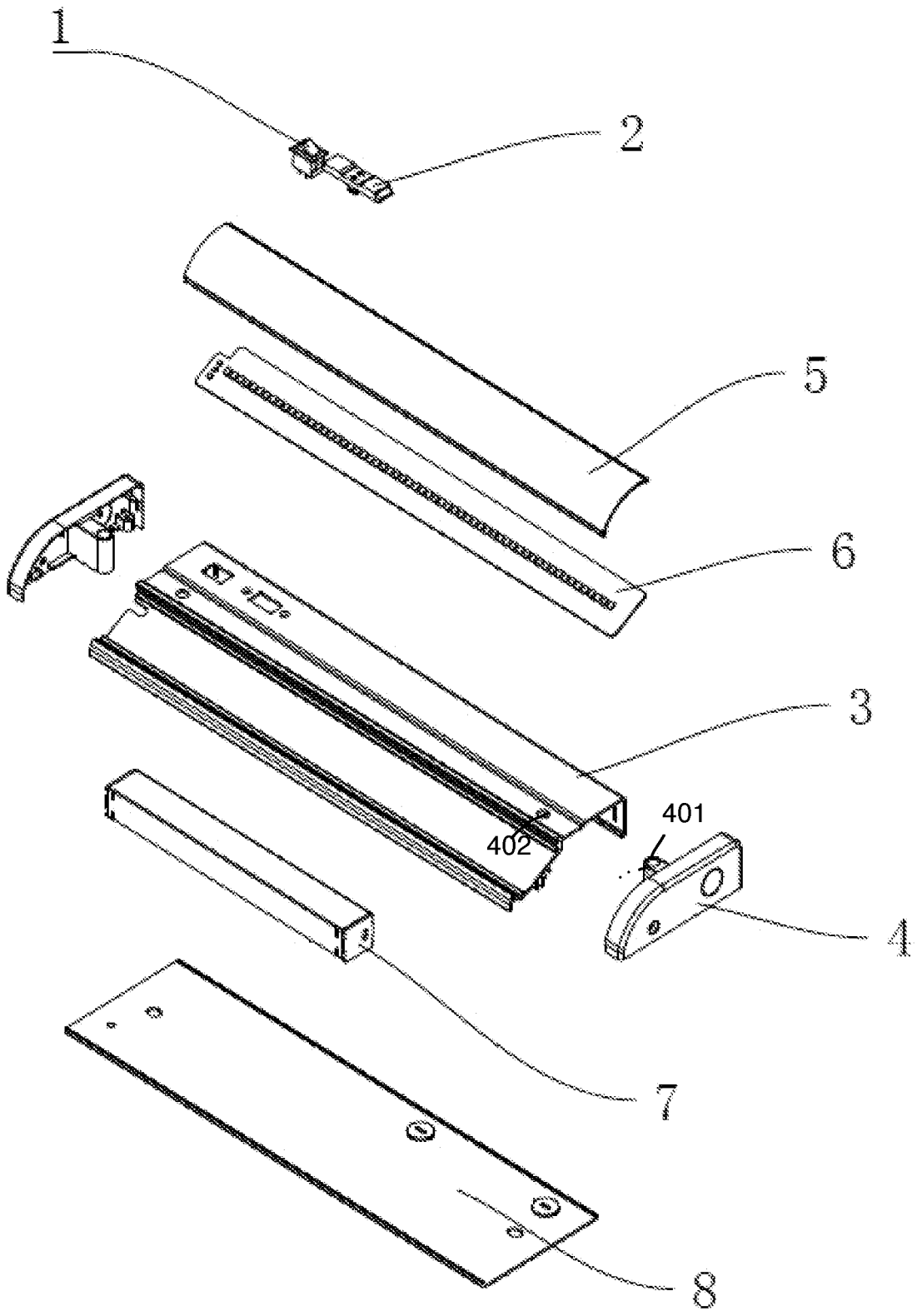
FIG. 2 illustrates an exploded view of the lighting apparatus in FIG. 1.

In FIG. 2, the first cap cover has a first cap connector 401 fixed to a first tube connector 402 of the polygonal tube for preventing the first cap cover detached from the polygonal tube.

Figure 13:
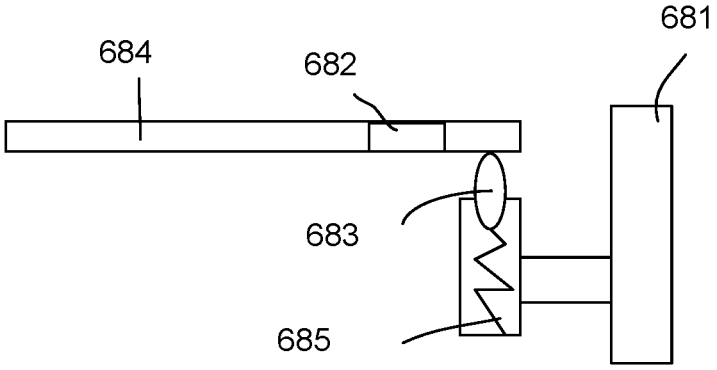
FIG. 13 shows a connection structure.

In FIG. 13, the first cap connector 681 has a protruding block 683 to be inserted to a connector hole 682 on the top plate 684 as the first tube connector.

In FIG. 13, the protruding block 683 has an elastic unit 685 for lowering the protruding block 685 when the protruding block 685 is moved along a first sliding track disposed on the top plate before the protruding block 685 is inserted to the connector hole 682 with an elastic force of the elastic unit 685.

In some embodiments, the first cap connector includes a screw hole aligning with a screw opening of the first tube connector for inserting a first screw to fix the polygonal tube with the first cap cover, as the example in FIG. 2.

Figure 14:
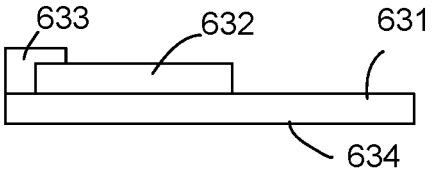
FIG. 14 illustrates a retractable curtain with a roller disposed on the light passing cover.

In FIG. 14, there is a retractable curtain 632 with a roller 633 disposed on the light passing cover 634 for selectively changing a illuminance area 631 of the light passing cover by covering a portion of the illuminance area.

Figure 1:
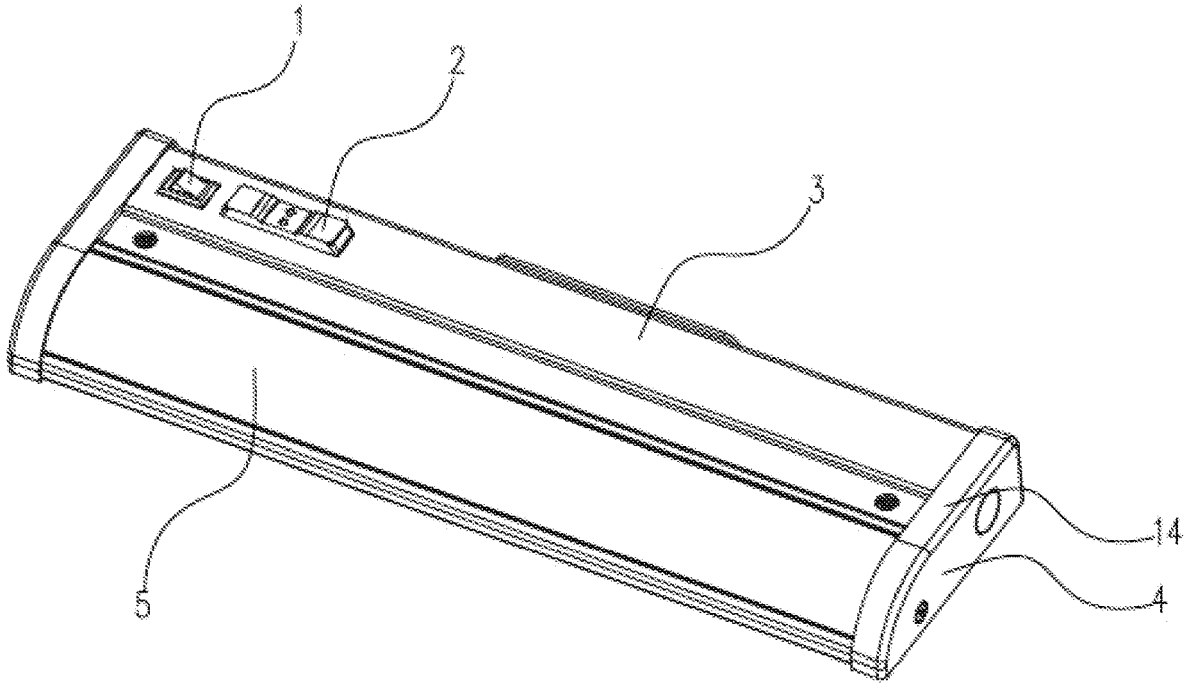
FIG. 1 illustrates a lighting apparatus.

In FIG. 1, a manual switch 2 is disposed on the top plate.

The manual switch is electrically connected to the driver for changing a control setting of LED modules on the light source plate.

In FIG. 9, the driver includes a driver circuit 60712 disposed on a driver plate 6071.

The driver plate 6071 is inserted into the inner container via a third sliding track 60713.

In some embodiments, the first cap cover 603 has an extending socket 6031 for routing electricity to another light device.

Please refer to FIG. 1. FIG. 1 shows a detail example of such embodiment. In FIG. 1, a tilt housing 3 has a switch button 1 and a manual switch 2. A light passing cover 5 is placed above a light source plate. A first cap cover 4 and a second cap cover are disposed on two sides of the tilt housing 3. There is protruding edge 14 in the first cap cover 4 to partially covering the tilt housing 3.

Please refer to FIG. 2. FIG. 2 shows an exploded view of the example in FIG. 1.

In FIG. 2, the light source plate 6, the driver 7 and the bottom cover 8 are further illustrated in addition to the disclosure of FIG. 1. Components with the same reference numerals refer to the same units and are not repeated again.

Figure 3:
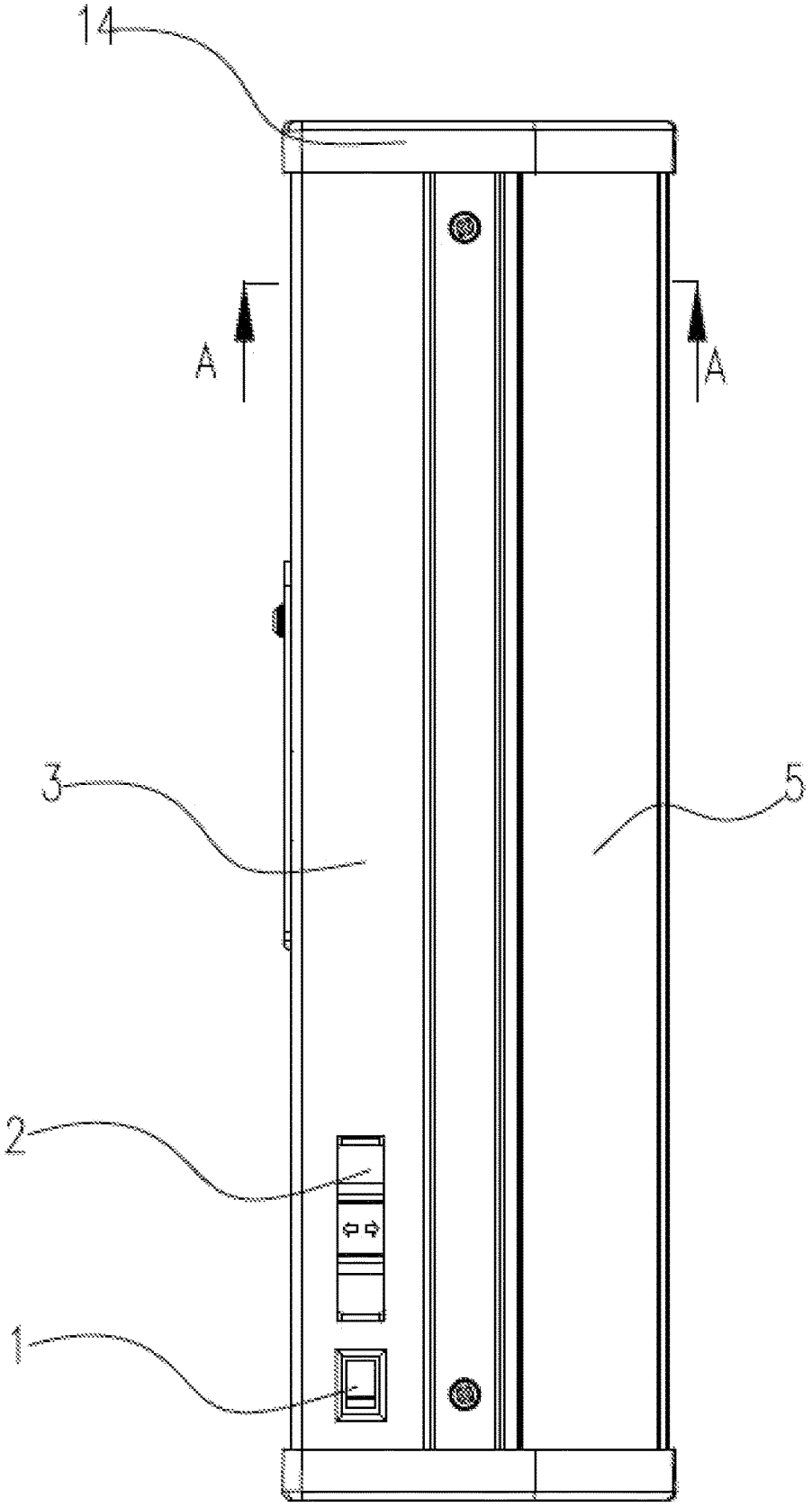
FIG. 3 illustrates a top view of the example in FIG. 1.

FIG. 3 shows a top view of the example in FIG. 1.

Figure 4:
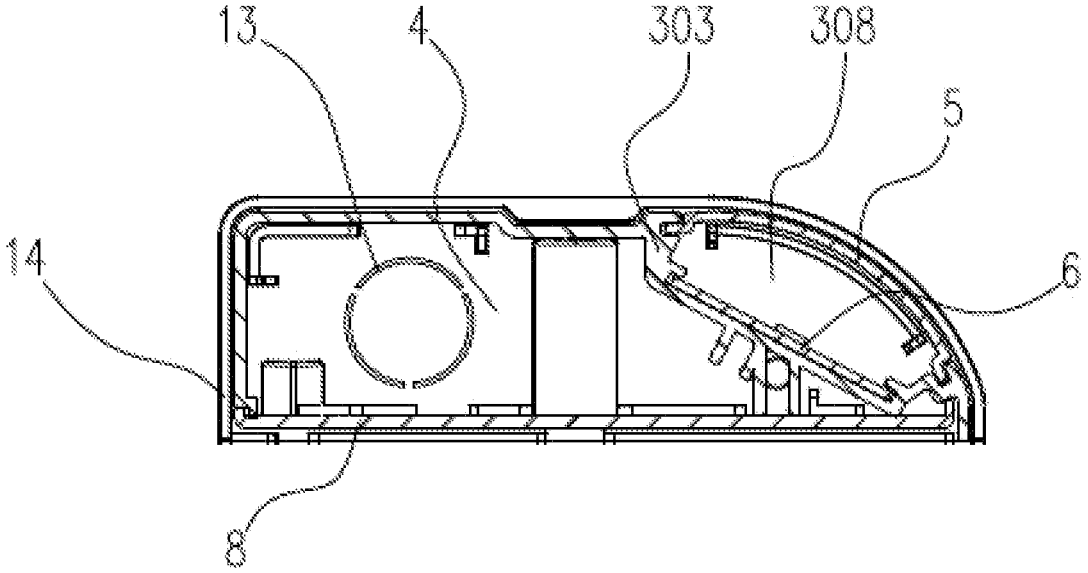
FIG. 4 illustrates a side view of a cross-sectional diagram showing relation among components in the embodiment of FIG. 1.

FIG. 4 shows a cross-sectional side view of the example in FIG. 1. In FIG. 3, there is a cavity 308 defined by the light passing cover 5 for diffusing a light of the light source plate 6. There is a tilt plate connector 303 for mounting a tilt plate for disposing the light source plate 6. There is a heat dissipation groove 13 defined by the tilt housing.

FIG. 5 shows an example of a tilt housing in the example of FIG. 1.

In FIG. 5, there are two sliding tracks 306, 307 for inserting a light source plate. The tilt plate connectors 303, 304 are used for fixing the light passing cover. There is a top plate 302 and a side plate 301 as explained the example of FIG. 9 above. Positioning structures like escape opening 305 may be disposed for aligning and fixing components.

Figure 6:
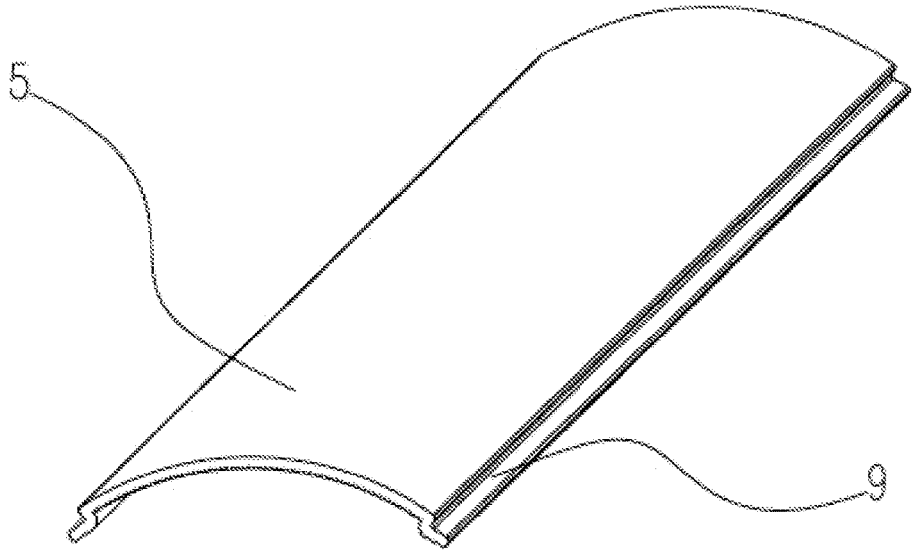
FIG. 6 illustrates a lighting passing cover example.

FIG. 6 shows a light passing cover 5 example with plug ears 9 on both edges.

Figure 7:
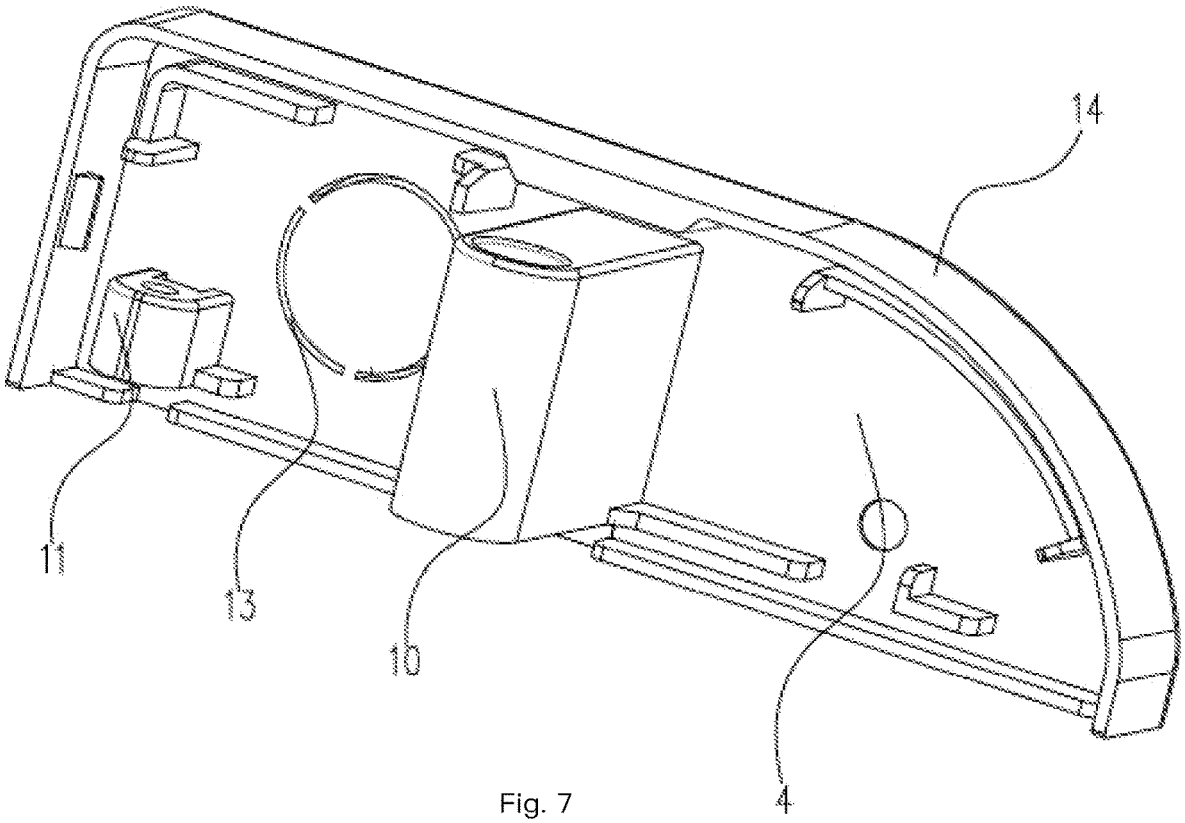
FIG. 7 illustrates an example of a first cap cover.

FIG. 7 further shows a connector 10 used for fixing to the tilt housing. The connector 10 has a hole for inserting a screw passing through a hole on the tilt housing. There is also an installation block 11 for installing and placing the driver.

Figure 8:
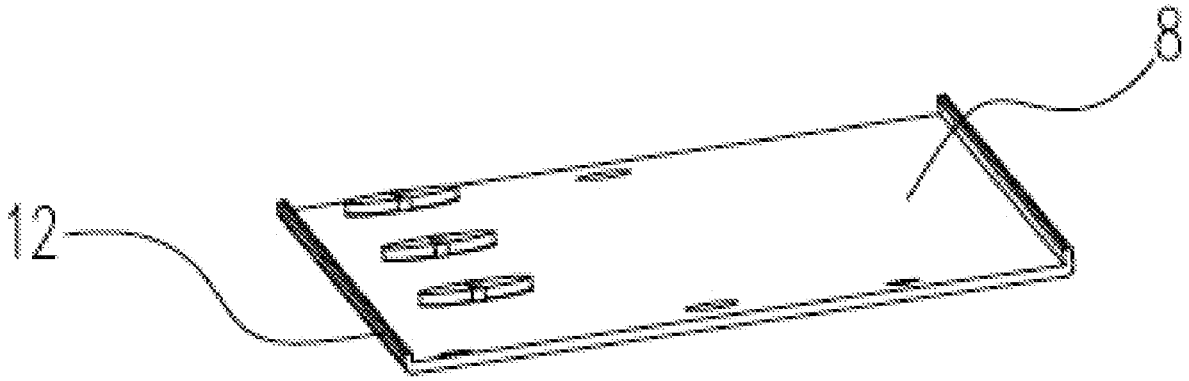
FIG. 8 illustrates an example of a bottom plate.

FIG. 8 shows a bottom plate 8 with protruding edges 12 for aligning and fixing the tilt housing mentioned above.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus to be installed in a closet, comprising:

a tilt housing comprising a tilt plate, a top plate and a side plate, wherein the tilt plate has a first side connected to the top plate, a tilt angle between the first side of the tilt plate and the top plate is between 100 degrees to 170 degrees;

a bottom plate having a front side connected to a second side of the tilt plate and having a back side connected to the side plate, wherein the second side is opposite to the first side in the tilt plate, the bottom plate and the tilt housing form a polygonal tube defining an inner container;

a first cap cover;

a second cap cover, wherein the first cap cover and the second cap cover are fixed to two opposite ends of the polygonal tube for concealing the inner container;

a driver disposed in the inner container;

a light source plate placed on an exterior side of the tilt plate; and a light passing cover having a top end fixed to the first side of the tilt plate and having a bottom end fixed to the second side of the tilt plate, wherein the first cap cover and the second cap cover respectively have a positioning groove for inserting two lateral sides of polygonal tube, the positioning groove ensure a shape of the polygonal tube unchanged, wherein the first cap has a first cap connector fixed to a first tube connector of the polygonal tube for preventing the first cap detached from the polygonal tube, wherein the first cap connector has a protruding block to be inserted to a connector hole on the top plate as the first tube connector, wherein the protruding block has an elastic unit for lowering the protruding block when the protruding block is moved along a first sliding track disposed on the top plate before the protruding block is inserted to the connector hole with an elastic force of the elastic unit.

2. The lighting apparatus of claim 1, wherein the tilt plate, the top plate and the side plate are elongated rectangular plates.

3. The lighting apparatus of claim 2, wherein the top plate and the tilt plate are connected with a first sliding track structure.

4. The lighting apparatus of claim 1, wherein the light source plate is placed on the exterior side of the tilt plate with a first sliding structure.

5. The lighting apparatus of claim 4, wherein the light passing cover is an elongated convex structure.

6. The lighting apparatus of claim 5, wherein the light passing cover has a pair of plugging ears to be inserted to a second sliding track.

7. The lighting apparatus of claim 5, wherein there are multiple prism units disposed on the light passing cover for diffusing a light of the light source plate.

8. The lighting apparatus of claim 5, wherein there are multiple wave bars protruding form a base surface of the light passing cover for diffusing a light of the light source plate.

9. The lighting apparatus of claim 1, wherein the light passing cover and the tilt plate are connected with a second sliding track structure.

10. The lighting apparatus of claim 1, wherein the first cap cover has a conductive path for electrically connecting LED modules on the light source plate and the driver.

11. The lighting apparatus of claim 10, wherein terminal plugs are disposed for electrically connecting the LED modules and the driver to the conductive path when the first cap cover is fix to the polygonal tube.

12. The lighting apparatus of claim 1, wherein the first cap connector comprises a screw hole aligning with a screw opening of the first tube connector for inserting a first screw to fix the polygonal tube with the first cap cover.

13. The lighting apparatus of claim 1, wherein there is a retractable curtain disposed on the light passing cover for selectively changing a luminance area of the light passing cover.

14. The lighting apparatus of claim 1, wherein a manual switch is disposed on the top plate, the manual switch is electrically connected to the driver for changing a control setting of LED modules on the light source plate.

15. The lighting apparatus of claim 1, wherein the driver comprises a driver circuit disposed on a driver plate, the driver plate is inserted into the inner container via a third sliding track.

16. The lighting apparatus of claim 1, wherein the first cap cover has an extending socket for routing electricity to another light device.

* * * * *